US005329836A

United States Patent [19]

Stannard

[11] Patent Number: 5,329,836

[45] Date of Patent: Jul. 19, 1994

[54] CHIME DEVICE HAVING QUICKLY RELEASABLE CHIME MEMBERS

[76] Inventor: John W. Stannard, Box 666, Crystal Beach, Fla. 34681

[21] Appl. No.: 4,040

[22] Filed: Jan. 15, 1993

[51] Int. Cl.[5] ..... G10D 13/08

[52] U.S. Cl. ..... 84/402; 84/406

[58] Field of Search ..... 84/402, 403, 404, 406, 84/408; 116/141, 148, 169

[56] References Cited

U.S. PATENT DOCUMENTS

| | | | |
|---|---|---|---|
| 578,749 | 3/1897 | Hyde | 84/406 |
| 656,603 | 8/1900 | Harrington | 84/406 |
| 3,533,323 | 10/1970 | Baxter | 84/404 |
| 4,237,767 | 12/1980 | Levine | 84/406 |
| 4,693,162 | 9/1987 | Lee | 84/404 |
| 4,881,442 | 11/1989 | Stevens | 84/403 |

*Primary Examiner*—Russell E. Adams

*Assistant Examiner*—Cassandra C. Spyrou

*Attorney, Agent, or Firm*—Joseph C. Mason, Jr.; Ronald E. Smith

[57] ABSTRACT

A musical instrument has a plurality of chime members disposed along its length, and each chime member is easily removed from the instrument or placed in a different position with respect to the other chime members. In some embodiments, plural slots are formed along the length of a base member and each chime member is suspended from a cord that is inserted into contiguous slots, and an elongate cover member overlies the base member to prevent inadvertent removal of the cords from their respective slots. Different structures are shown for spacing the cover apart from the base when it is desired to remove one or more cords from its associated slot. In additional embodiments, each chime member is suspended from a module, and the module releasably engages the base member.

6 Claims, 8 Drawing Sheets

CHIME DEVICE HAVING QUICKLY RELEASABLE CHIME MEMBERS

BACKGROUND OF THE INVENTION

1. Field of the Invention

This invention relates, generally, to musical instruments of the percussion type. More particularly, it relates to a structure that enables quick detachment and re-attachment of individual chime members from and to a chime device.

2. Description of the Prior Art

Most chime devices include a base member from which is suspended a plurality of individual chime members. Typically, the base member is of linear configuration; the chime members depending therefrom are therefore in linear alignment with one another. However, the base member and hence the chime members may be formed and disposed, respectively, in configurations other than linear configurations.

There are two primary classifications of chime devices of the type that are the subject of this invention: those where the chime members are suspended from a base member by a single elongate cord means that extends along the extent of the base member, and those having means for individually suspending each chime member.

This disclosure relates to the second type of musical instrument, i.e., it relates to chime devices having individually suspended chime members.

In both classifications, the individual chime members are bored at their uppermost ends so that a string or cord means can be threaded through the bore; each chime member thus hangs from the cord means and the cord means is secured to the base member.

In designs where the chime members are suspended from a common cord means, replacement or rearrangement of individual chime members is problematic. Moreover, if the cord breaks at any point, it is not a simple matter to replace it. Accordingly, most advances in the art are being made in designs having individually-suspended chime members. Perhaps the most popular design for individually-mounted chime members, prior to the disclosure of the present invention, is a design where molded plastic or Nylon price tag ties are used as the cord means to suspend the individual chime members. A plurality of equidistantly and longitudinally spaced bores are formed along the extent of the base member, said bores being transversely disposed relative to the longitudinal axis of the base member, and one end of an open price tag tie is introduced through each bore. A free end of each tie is then threaded through the bore formed in its associated chime member, and said free end is then engaged to the other free end of said tie means. This produces a closed loop where the top end of the loop extends through the transverse bore formed in the base member of the chime device and where the bottom end of said loop extends through the bore formed in its associated chime member. Although the free ends of the tie means may be interlocked in the absence of tools, most chime device manufacturers employ a specially-designed tool to perform the interlocking to thereby increase productivity.

There are a number of drawbacks associated with this well-known design. First of all, although it is a simple matter to interlock the free ends of each tie, it is a much more difficult matter to disengage said free ends. Thus, the musician is not encouraged to rearrange the individual chime members; replacement of damaged chime members is also problematic. Moreover, even if the ends of the tie means can be disengaged from one another, said tie means usually cannot be re-used due to the damage done to it by the disengagement process. Thus, each disengaged tie means must be replaced.

Another drawback of the price tag ties is that, being made of molded plastic, they are relatively inflexible. Thus, they reduce the quality of sound generated by the chime device.

Some manufacturers eschew use of the price tag ties because of their aforesaid quality-diminishing properties, and prefer to use more flexible, string-like cord means to form the individual loops for holding the chime members. However, this requires that a knot be formed in each cord means after it is threaded through the bore formed in the base member and the bore formed in its associated chime member. Such knot-tying is time-consuming and thus adversely affects productivity. Moreover, the diameter of the cord means must be large enough to facilitate the knot-tying procedure, i.e., it is difficult to form a knot in a cord means of very small diameter. Unfortunately, use of large diameter cord also serves to diminish the quality of the sounds generated by the chime device. More specifically, high frequency sounds are increasingly attenuated as cord thickness increases.

What is needed, then, is a structure where the chime members are individually suspended from the base of the chime device, and where individual chime members are quickly and easily rearranged, replaced, or removed in the absence of special tools. Moreover, the means allowing such quick and easy rearrangement of individual chime members should have a structure that may be re-used numerous times without deterioration, and such means should enable use of a flexible cord means of small diameter so that the quality of the music generated by the device is not diminished. However, the prior art, considered as a whole as required by law, neither teaches nor suggests how the limitations of the known chime mounting means could be overcome.

SUMMARY OF THE INVENTION

An elongate chime device includes an elongate, one piece cover member and an elongate, one piece base member in a first embodiment or a plurality of truncate base members in a second embodiment. In both of the first two embodiments of this invention, a separate cord means is dedicated to each chime member, the cover member overlies the upper surface of the base member when the chime device is in use, and each cord that holds its associated chime member is releasably secured to the base member. More particularly, the base member is slotted along its extent to receive each cord. To change the position of or to remove an individual chime member, means are provided to separate the cover member from the base member so that the cord may be lifted from its slots formed in the base member. In both embodiments, the base member or members may be pivoted in relation to the cover member or displaced away therefrom in a sliding motion. In either event, the upper surface of the base member or base members is exposed only when said base member has been displaced relative to the cover member, and such uncovering enables the musician to easily rearrange, remove or replace individual chime members.

No cover member is required in the third embodiment. Individual mounting of each chime member to the bottom surface of the base member is attained by attaching the opposite ends of each individual cord means to a modular quick release fastening means, there being a separate cord means dedicated to each chime member as in the first two embodiments. The module releasably engages the bottom surface of the base member with magnetic fastening means, snap fasteners, press fit fastening means, hook and loop fasteners, and the like. The bottom surface of the base member mates with the module; rearrangement, removal or replacement of individual chime members is accomplished by disengaging the modules from the base as needed.

The last-illustrated embodiment is similar to the first two, i.e., non-modular embodiments. In said last-illustrated embodiment, the cover member of the first two embodiments is hingedly secured to the base member, thereby obviating the need to pivotally or slideably interconnect the base member to the cover.

In the non-modular embodiments, cord-receiving slots may be formed in the front and back surfaces of the base member, so that two rows of individual chime members may be suspended along the extent thereof. In the modular embodiments, the base member may be widened so that two or more rows of chime members can be suspended therefrom.

An important object of this invention is thus understood to be the elimination of nail, screw, or similar non-quick-release fastening devices in musical instruments of the chime type.

Another important object is to replace the fastening devices heretofore known with unique quick release fastening means that enable facile rearranging, removal or replacement of individual chime members in a chime device in the absence of special tools.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
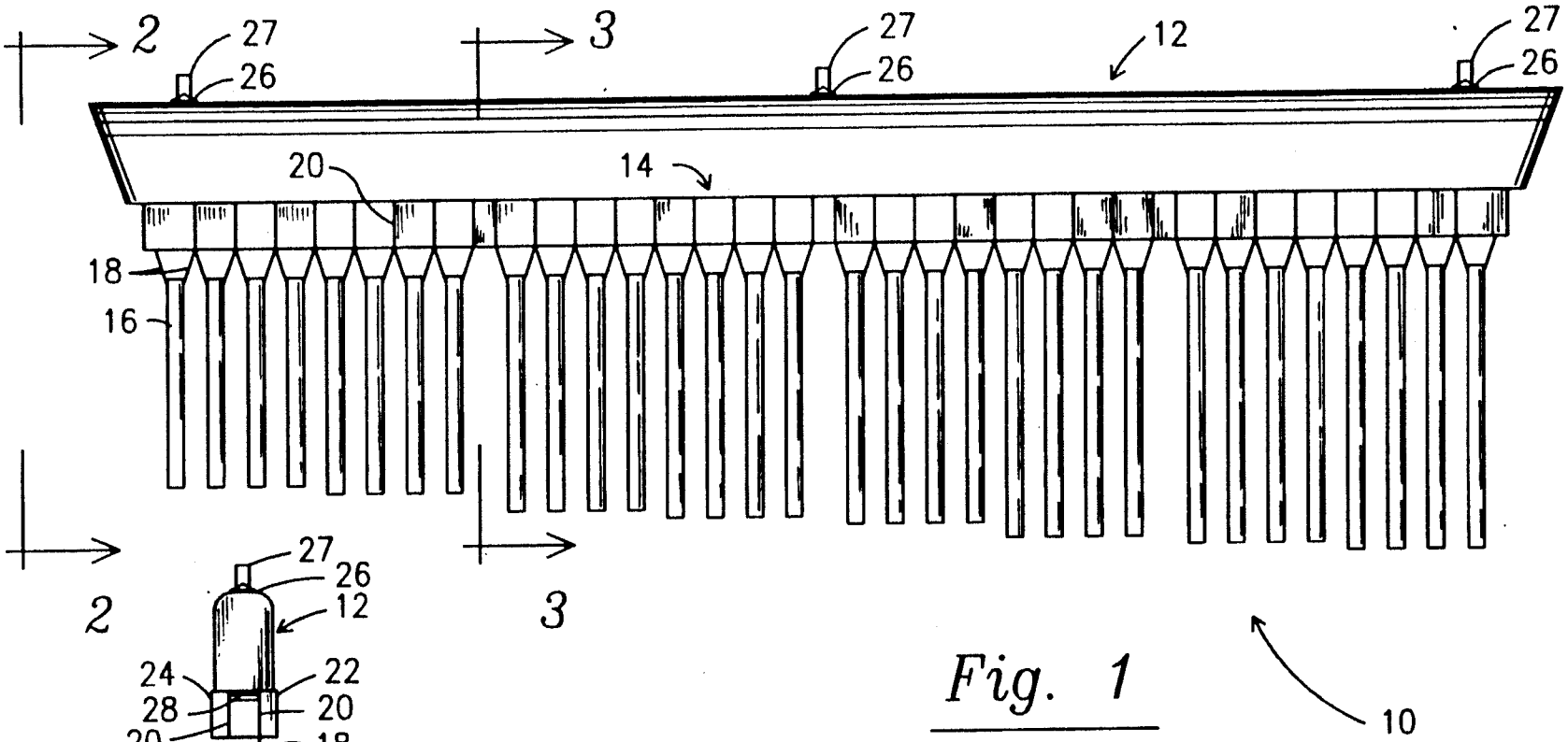
FIG. 1 is a front elevational view of a first embodiment of the invention.

Referring now to FIG. 1, it will there be seen that the first embodiment of the invention is denoted 10 as a whole. Elongate chime device 10 includes an elongate cover 12 and an elongate base 14. As shown in FIG. 1, when the instrument is in use, the bottom surface of cover 12 overlies the upper surface of base 14. Each individual chime member of a plurality of individual chime members is denoted 16, and is suspended from base 14 by a flexible string or cord means 18 that is formed in a closed loop. Thus, there are as many cord means 18 as there are individual chime members 16. Each chime member 16 is bored at its upper end to receive the cord means 18 diametrically therethrough.

Figure 2:
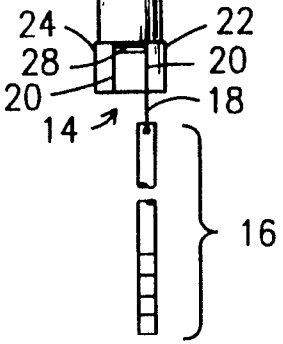
FIG. 2 is an end view taken along line 2—2 in FIG. 1.

A plurality of parallel slots, collectively denoted 20, are formed in the front surface 22 of base 14 and in the back surface 24 thereof as well. The depth of the slots is shown in FIG. 2. Accordingly, it should be understood that chime device 10 may hold two parallel rows of individual chime members 16. Each slot extends from the top surface of base 14 to the bottom surface thereof and is formed in, i.e., extends into, said top and bottom surfaces to the extent shown in FIG. 2. It should also be understood that the part of each cord means 18 not visible in FIG. 1 is disposed in overlying relation to the top surface of base 14. Thus, the bottom surface of cover 12 is disposed in overlying relation to said not-visible part of each cord means when the chime device 10 is in the configuration depicted in FIGS. 1 and 2. In this way, each cord means 18 is held into position by said bottom surface of said cover 12. It should also be observed in FIGS. 1 and 2 that the slots at the opposite ends of the base 14 are formed in the end surfaces thereof and not the front and back surfaces; the structural integrity of the base is weakened if the end slots are formed in the front and back surfaces thereof.

Figure 3:
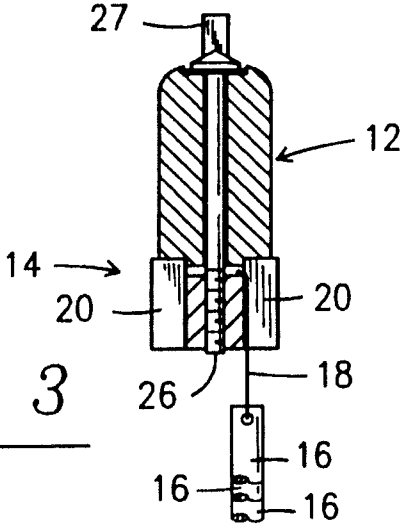
FIG. 3 is a sectional view taken along line 3—3 in FIGS. and 7.

A plurality of bolt members, collectively denoted 26, are employed to secure cover 12 to base 14, and each bolt 26 has a tool-engageable head 27 at a first end thereof; of course, a wing nut or other fastening means of the type requiring no tools may be used as well. As shown in FIG. 3, the second end of each bolt 26 screw threadedly engages an internally threaded bore formed in base 14. Thus, tightening bolts 26 causes cover 12 to tightly overlie base 14.

A central, longitudinally-extending ridge 28 is formed in the bottom surface of cover 12, and said ridge 28 keys into a complementally-formed recess that is formed in the top surface of base 14; this keys cover 12 to base 14 and facilitates alignment of said parts when the chime device 10 is being assembled.

Figure 4:
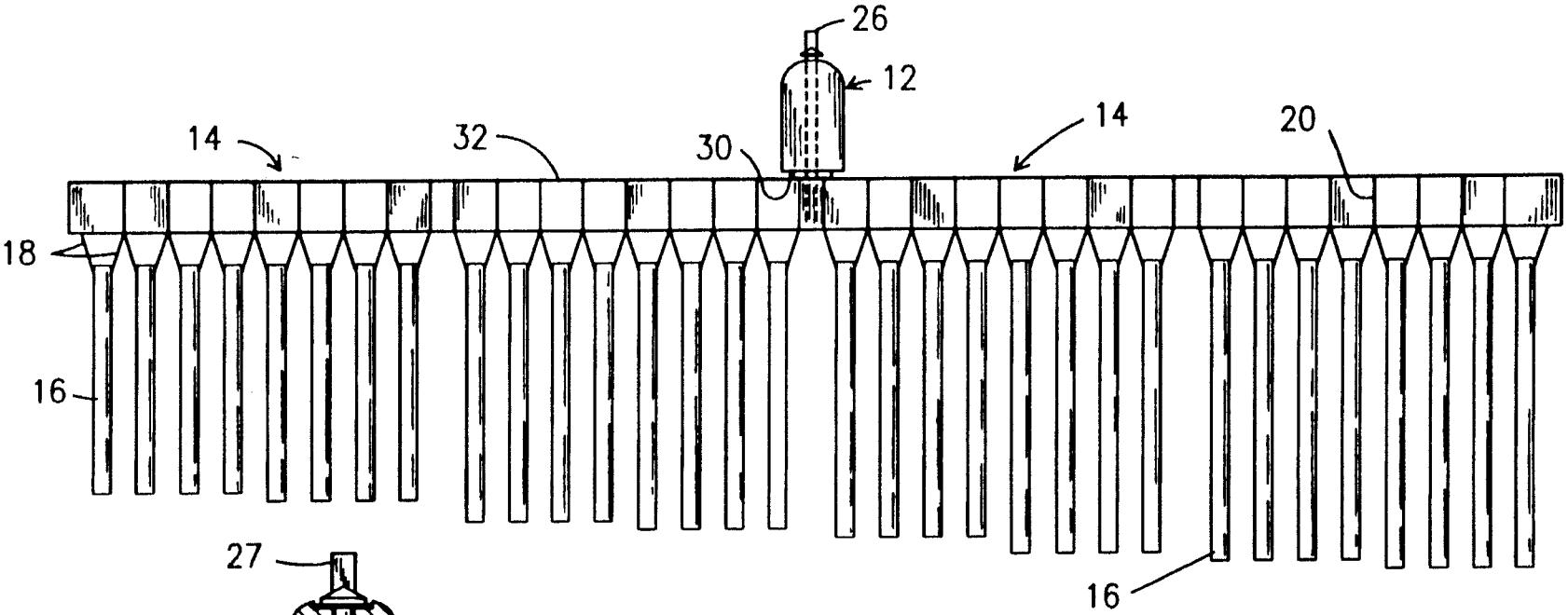
FIG. 4 is an end view of the first embodiment when the base thereof is rotated ninety degrees with respect to the longitudinal axis of the cover.

When the bolts 26 at the opposite end of device 10 are removed and the center bolt is loosened, base 14 may be rotated with respect to cover 12, as depicted in FIG. 4. When so rotated, the bottom surface of cover 12 does not cover top surface 32 of base 14; thus, each cord means 18 may be lifted from its associated slot. This enables the musician to rearrange the individual chime members 16 into any desired pattern, or to replace damaged chime members.

Figure 5:
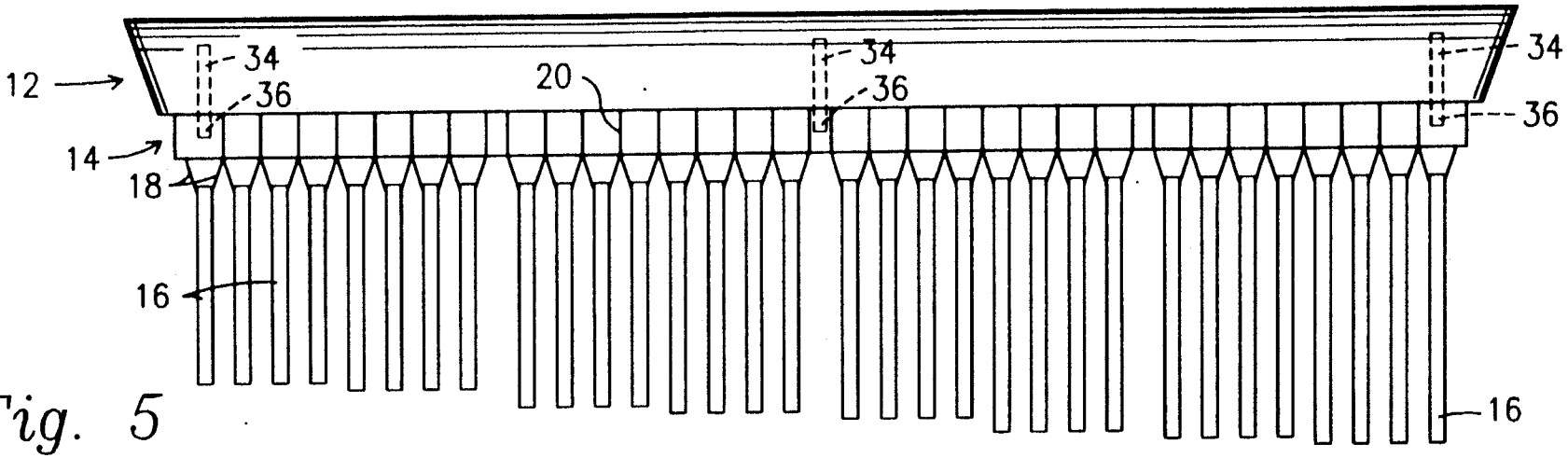
FIG. 5 is a front elevational view of a second embodiment of the invention, showing the cover in overlying relation to the base.
Figure 6:
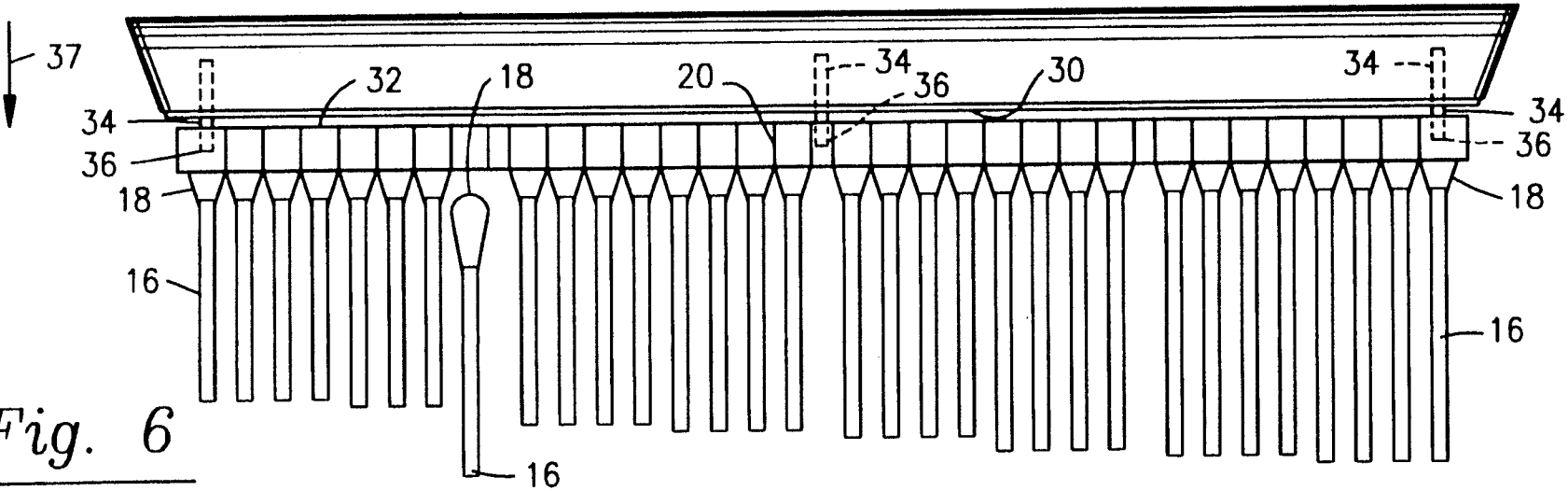
FIG. 6 is a front elevational view of said second embodiment, showing the cover in spaced apart relation to the base.

Another variation of the first embodiment, having no bolts 26, is shown in FIGS. 5 and 6. Plural dowel pins, collectively denoted 34, are press fit at a first end into bores formed in cover 12 and are permanently secured at a second end within aligned bores 36 formed in base 14 as shown. Thus, by pulling base 14 away from cover 12, as indicated by directional arrow 37 in FIG. 6, each pin 34 slides within the bore formed within the cover; this separates bottom surface 30 of cover 12 from upper surface 32 of base 14 as shown in said FIG. 6 and enables facile lifting of each looped cord means 18 from its associated contiguous slots 20, as also indicated in said FIG. 6. The separation of cover 12 and base 14 may be slight as depicted, or much larger. When the separation is small, the cord means 18 is lifted from its slots by lifting its associated chime member 18; when the separation is larger, the same cord removal technique may be used, or the fingers may be used to lift said cord means from the top surface 32 of base 14 and hence from its slots.

Figure 7:
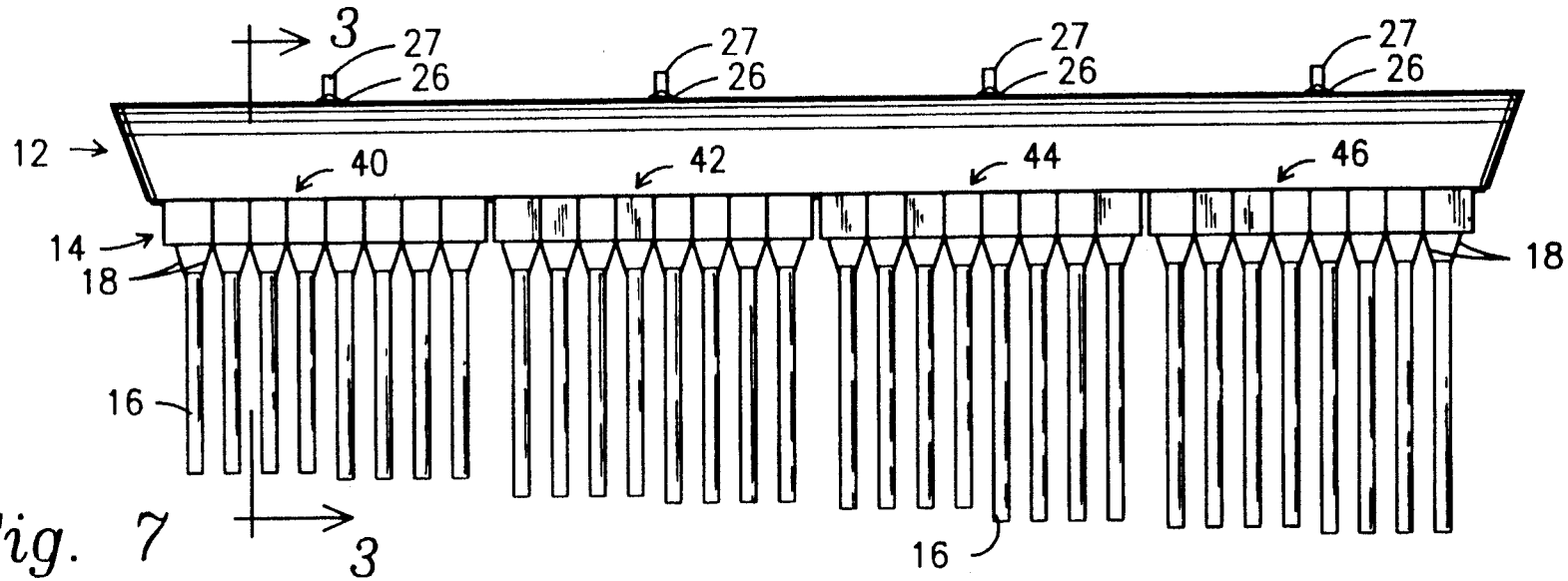
FIG. 7 is a front elevational view of a third embodiment.
Figure 8:
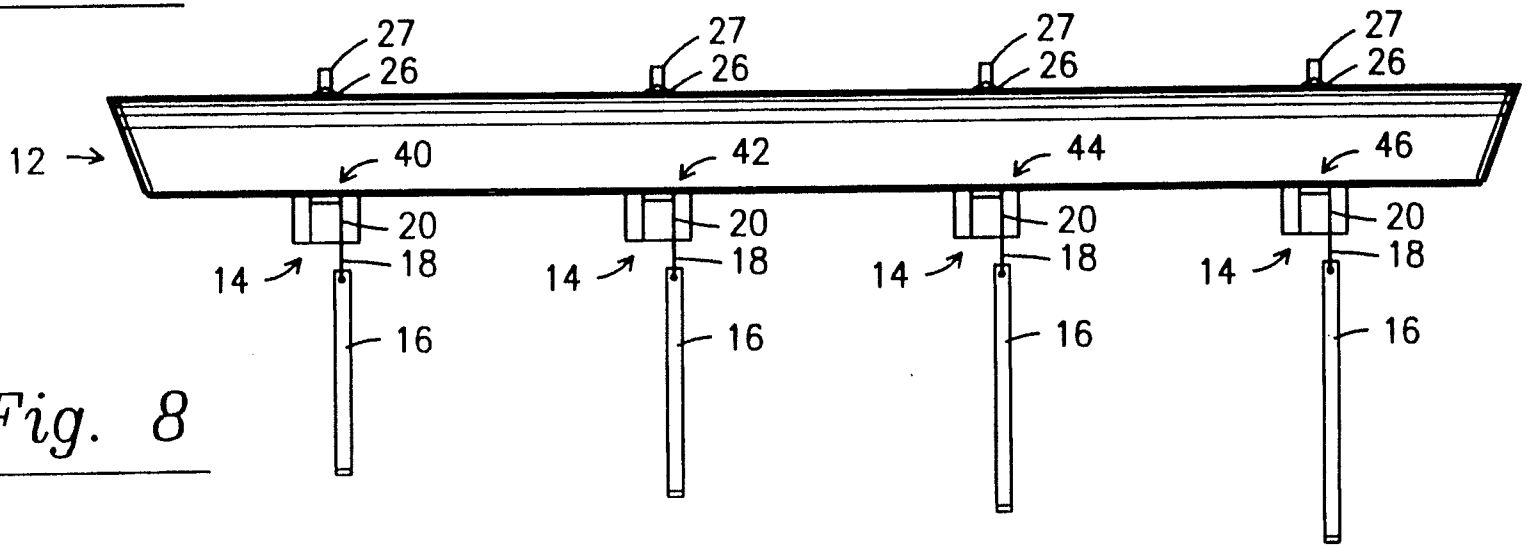
FIG. 8 is a front elevational view of said third embodiment when the base members thereof are rotated ninety degrees with respect to the cover.

A second embodiment is illustrated in FIGS. 7 and 8. Base 14 is subdivided into separate parts or sections, denoted 40, 42, 44, and 46. A bolt 26 having tool-engageable head 27 is associated with each base section so that when said bolts are loosened, said sections may be rotated ninety degrees with respect to the longitudinal axis of cover 12, as depicted in FIG. 8, thereby enabling facile rearrangement, removal or replacement of individual chime members 16 in the manner described above. Note also that when slots are formed along the front and the back of each base section, the musician can change from one musical scale to another simply by reversing the orientation of a base section. Thus, a plurality of chime members collectively providing a C scale when played could be arranged on a first side of a base section, and a pluraity of chime members collectively providing a D scale when played could be arranged on a second side thereof. Thus, the musician could switch scales simply by loosening bolt 26 and reversing the position of a base section. Such flexibility in chime devices was heretofore unknown.

It should be observed at this point that each chime member 16 need not be suspended with a looped cord means 18. Instead, a knot, not shown, having a diameter greater than the diameter of each slot 20, may be tied in opposite ends of a cord means 18 that is not looped, and said opposite ends of said cord means may be inserted into contiguous slots with the knots thereof resting atop upper surface 32 of base 14. The size of each knot would prevent it from entering into its associated slot. This technique also enables facile removal of individual chime members, and it should be understood that said knotted cord means could be used in all embodiments of this invention where slots are provided in base member 14.

Figure 9:
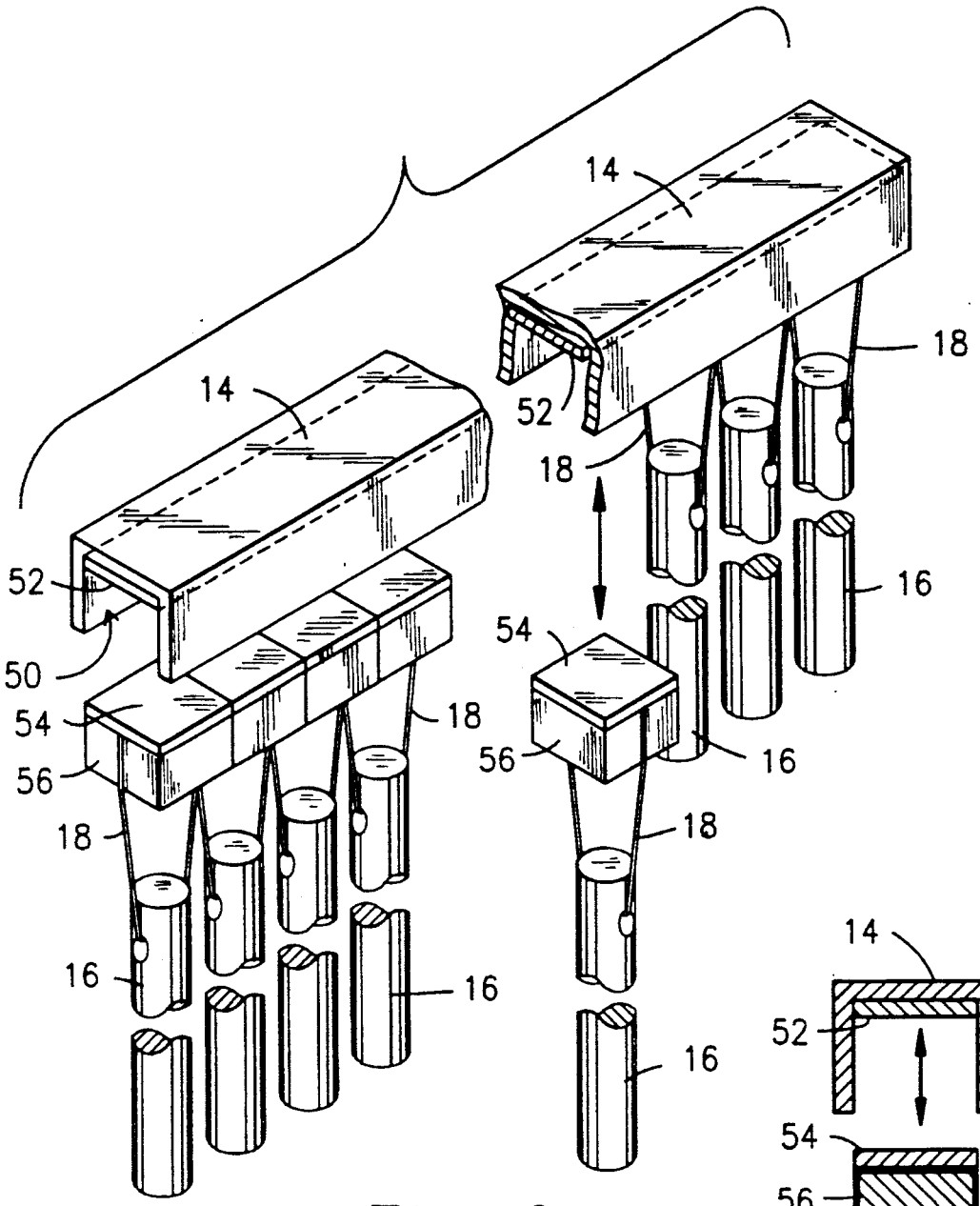
FIG. 9 is a perspective view of the first modular embodiment, showing magnetic modules disposed in two different orientations.
Figure 10:
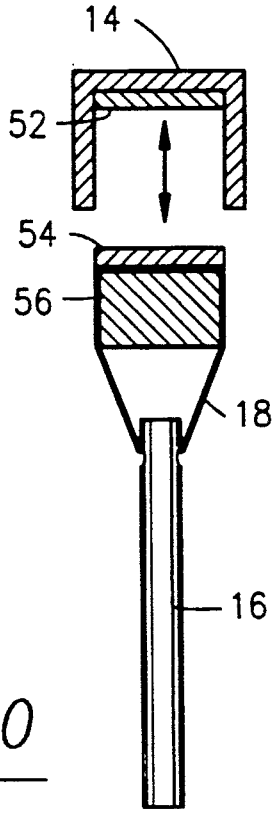
FIG. 10 is a transverse sectional view of the base member and a magnetic module.

The first variation of the modular embodiment is shown in FIGS. 9 and 10; the modular embodiment employs no slots 20, but still provides quick and easy release and reattachment of individual chime members. A channel 50 is formed in the bottom surface of base 14, and a flat strip of ferrous material 52 is fixedly secured to the bottom of such channel. A magnet 54 is fixedly secured to the top surface of a module 56, and magnet 54 releasably engages strip 52, as shown in the right-hand side of FIG. 9 and as indicated in FIG. 10 by the double-headed directional arrow. Note also that the orientation of the modules 56 at the left-hand side of FIG. 9 is different from the orientation of the modules at the right-hand side. The orientation of the modules at the right-hand side provides less resistance to movement of the chime members when they are stroked by a suitable instrument. Those skilled in the art of machine design will observe that channel 50 need not be formed in base 14 and that the strip of ferrous material 52 could simply be affixed to the lower surface of said base member 14. Moreover, the entire base member 14 could be made of a ferrous material, thereby eliminating strip 52, the entire module 56 could be magnetic, and so on.

Figure 11:
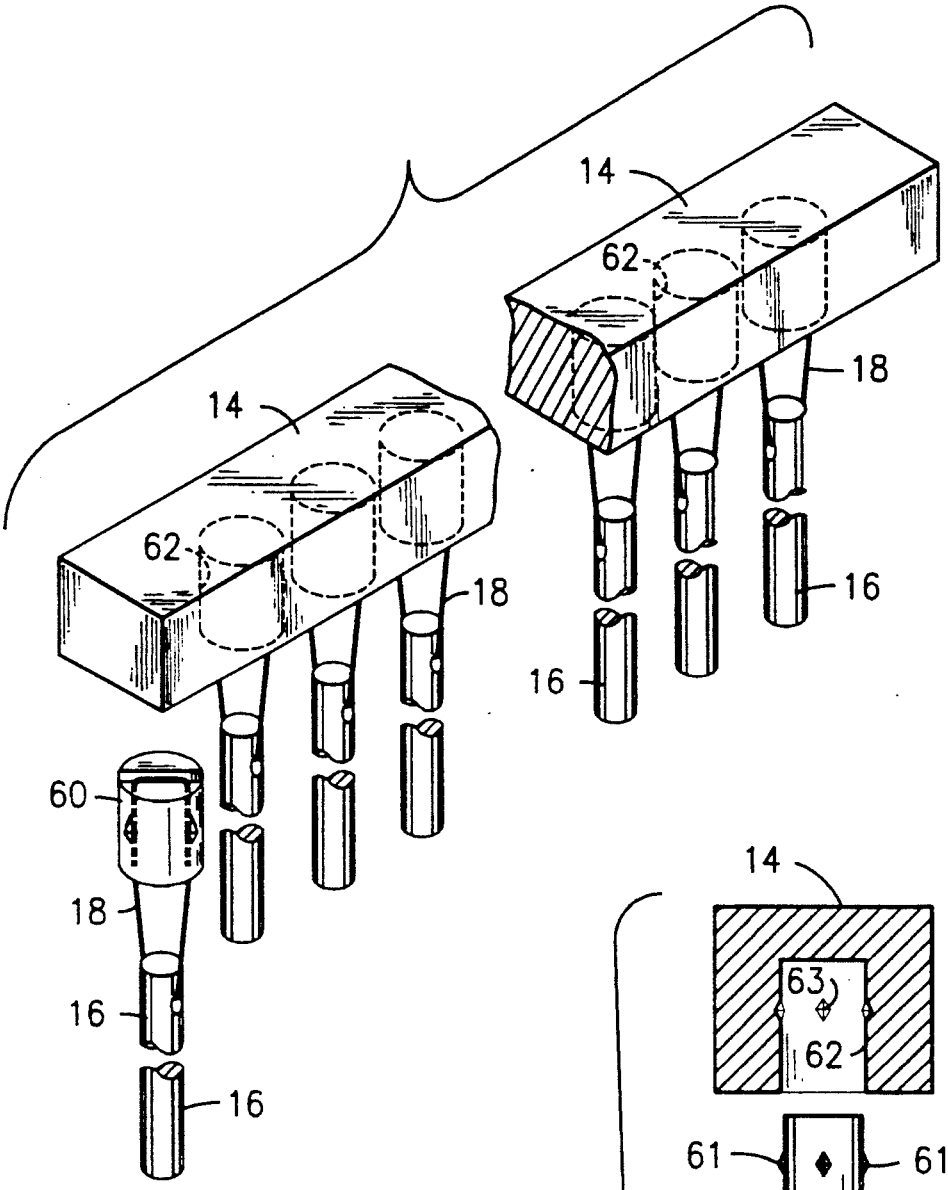
FIG. 11 is a perspective view of the second modular embodiment.
Figure 12:
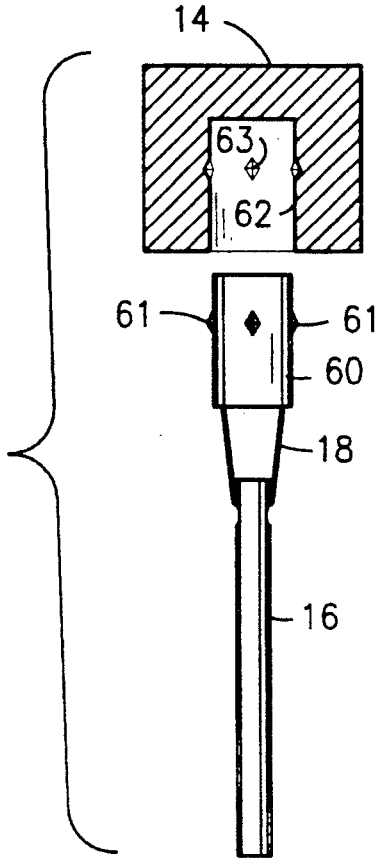
FIG. 12 is a partially transverse sectional view of the second embodiment.

In the embodiment of FIGS. 11 and 12, the opposite ends of each cord 18 are fixedly secured to a quick release fastening means such as modular snap fit member 60, and a mating bore means 62 that releasably engages said snap fit member 60 is formed in the bottom surface of base 14. More particularly, protuberances 61 formed in module 60 releasably engage complementally formed recesses 63 formed in bores 62 in the well-known way. Thus, each chime member may be quickly and easily replaced or rearranged as desired. As in the embodiment of FIGS. 9 and 10, the orientation of the chime members within their associated bores may be selected by rotating the modules ninety degrees to provide more or less resistance to movement when stroked by a suitable instrument. Numerous other snap-fit mechanisms are within the scope of this invention.

Figure 13:
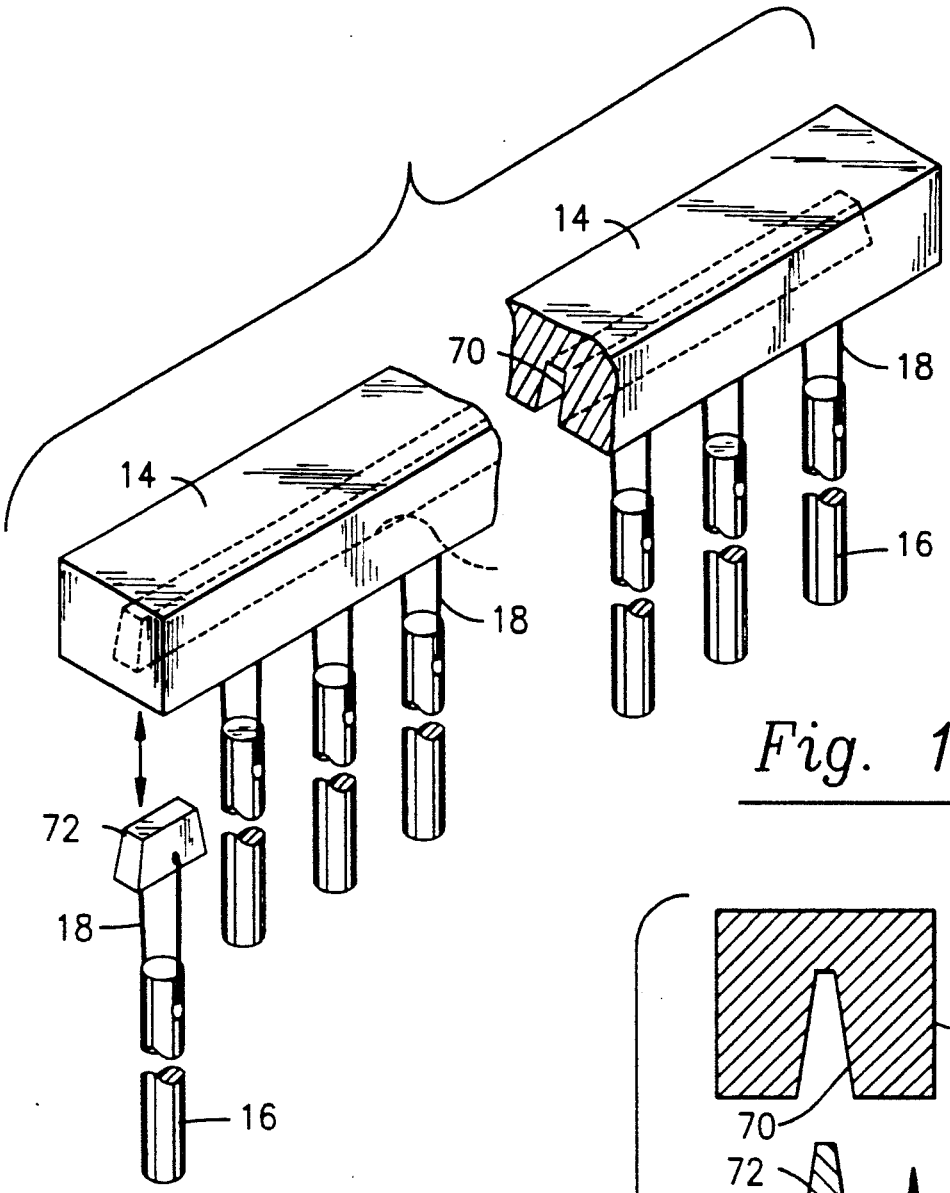
FIG. 13 is a perspective view of the third modular embodiment, showing two alternative forms of press fittable modules.
Figure 14:
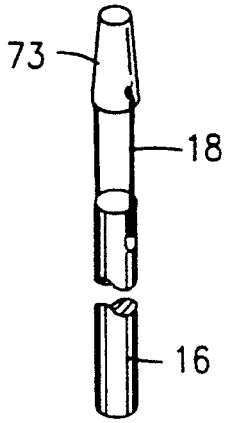
FIG. 14 is a perspective view of a chime member equipped with a module adapted for press fit engagement with the base member.
Figure 15:
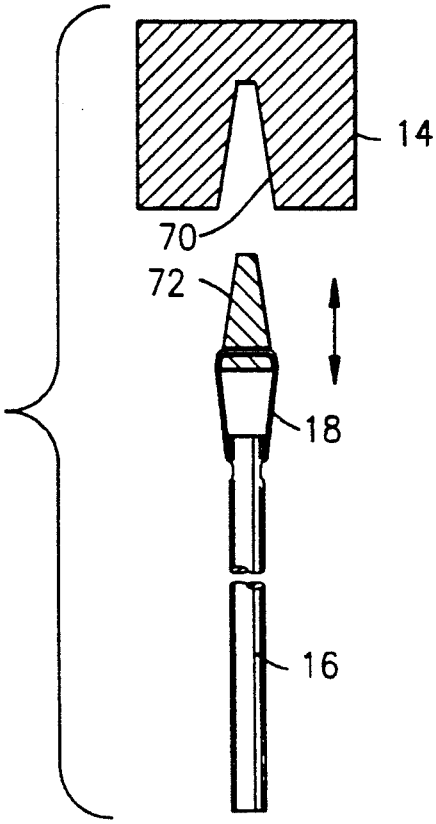
FIG. 15 is a transverse sectional view of the base member and a module of the press fit type.

In the embodiment of FIGS. 13 and 15, an elongate tapered channel 70 is formed in the bottom surface of base 14, and complementally formed plugs 72 are provided for press fit insertion thereinto. Alternatively, as suggested in FIG. 14, the plugs may have a frusto-conical shape, and multiple mating bores, not shown, may be formed in the bottom surface of base 14 in lieu of elongate channel 70.

In an unillustrated embodiment, neither channels nor bores are formed in the bottom surface of base 14. Instead, a hook and loop fastener material is fixedly secured to the bottom surface of base 14, and a mating hook and loop fastener is fixedly secured to the top surface of each module. Alternatively, a hook and loop-type fastener material could be positioned at the bottom of a channel like channels 50 or 70 or at the bottom of bores like bores 62, and a mating material could be adhered to the top surface of a complementally-formed module.

Figure 17:
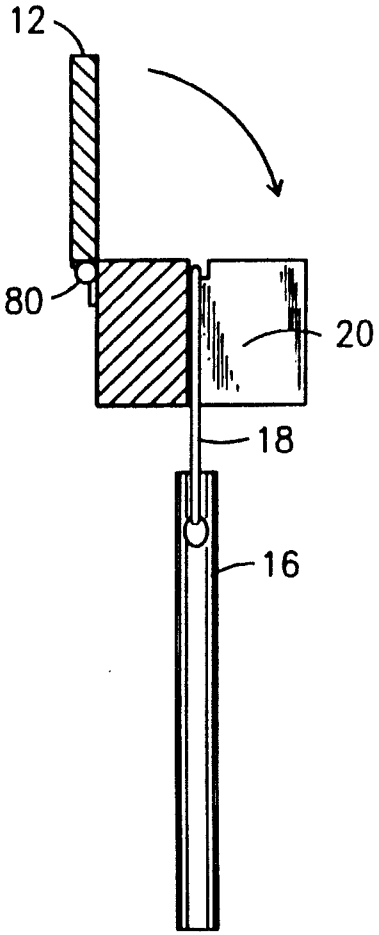
FIG. 17 is a transverse sectional view of said final illustrated embodiment, showing a chime member secured thereto in side elevation.
Figure 16:
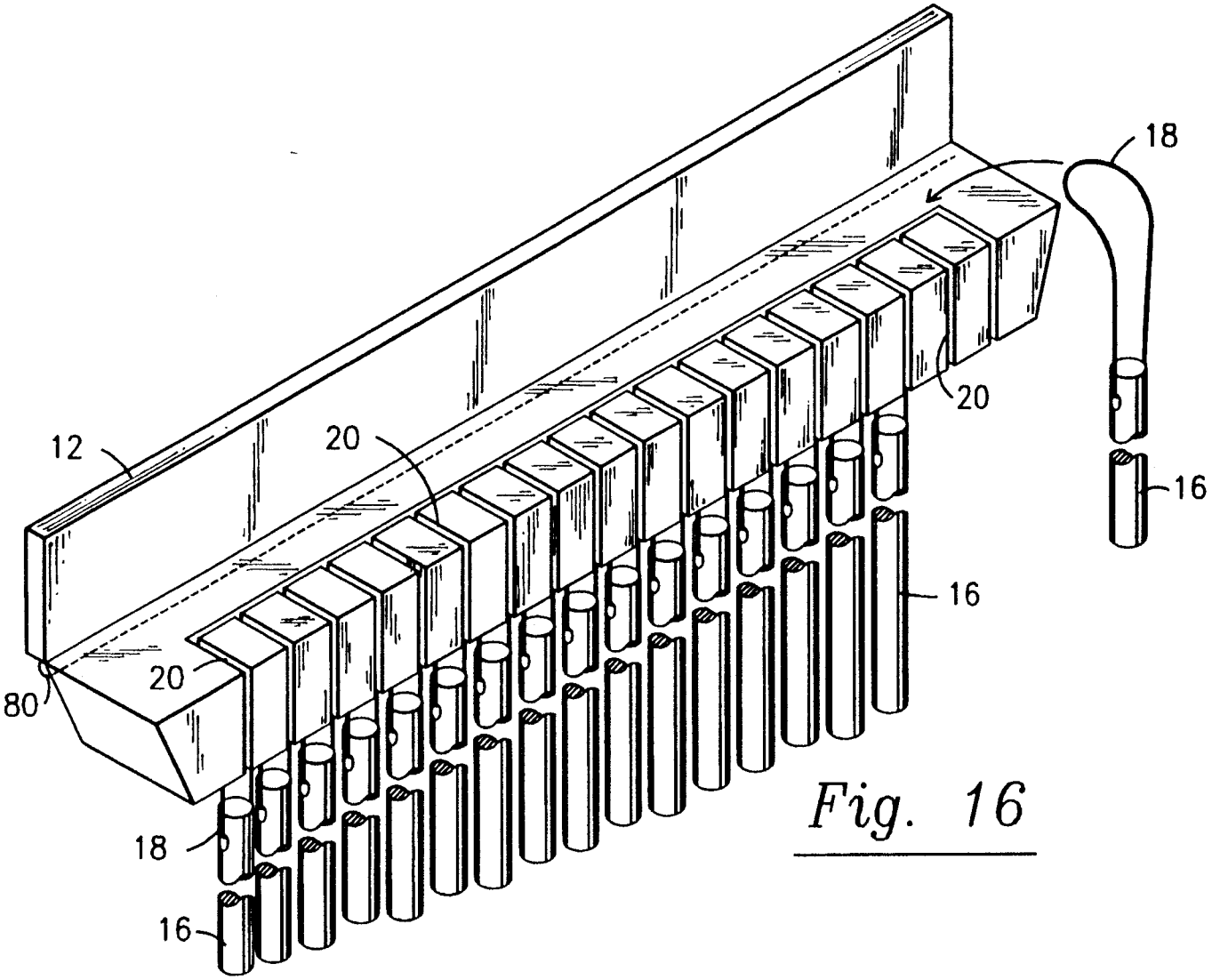
FIG. 16 is a perspective view of the final illustrated embodiment where the cover is hingedly attached to the base.

The last of the depicted embodiments is shown in FIGS. 16 and 17, but it should be clear by now that, since a few examples of this invention have now been disclosed, other quick release fastening means for enabling ready attachment and detachment of individual chime members 18 are within the scope of this invention as well, whether depicted or not. It would unduly lengthen this specification to include many alternative embodiments, all of which should now be obvious now that this disclosure has been made.

Like the first two embodiments, the embodiment of FIGS. 16 and 17 relies upon slots 20. However, cover 12 is hingedly secured to base 14 by an elongate piano hinge 80 to facilitate easy attachment and release of each cord means 18 as indicated by the directional arrow in FIG. 16. The directional arrow in FIG. 17 shows how the cover 12 closes over base 14 after chime members 16 have been installed. Thus, it is a simple matter to lift the cover 12 when it is desired to remove or rearrange individual chime members.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A chime device having quickly detachable individual chime members, comprising:

an elongate base having a top surface, a bottom surface, a front surface, and a back surface;

an elongate cover disposed in abutting, overlying relation to said top surface;

means for spacing said base and cover apart from one another;

a first plurality of parallel slots formed in said base member along the extent thereof;

said first plurality of parallel slots being formed in said front surface and having a predetermined depth such that the upper and lower ends thereof are formed to the extent of said predetermined depth in said top and bottom surfaces, respectively;

whereby an individual chime member suspended from a looped cord means is suspended from said base member by inserting said cord means through a pair of contiguous slots of said first plurality of parallel slots when said base and cover are spaced apart from one another and is removed from said base member by lifting said cord means from said contiguous slots when said base and cover are spaced apart from one another.

2. The device of claim 1, further comprising a second plurality of parallel slots formed in said base member along the extent thereof;

said second plurality of parallel slots being formed in said back surface and having a second predetermined depth such that the upper and lower ends thereof are formed to the extent of said second predetermined depth in said top and bottom surfaces, respectively;

whereby an individual chime member suspended from a looped cord means is suspended from said base member by inserting said cord means through a pair of contiguous slots of said second plurality of parallel slots when said base and cover are spaced apart from one another and is removed from said base by lifting said cord means from said contiguous slots when said base and cover are spaced apart from one another.

3. The device of claim 1, wherein said means for spacing said base and cover apart from one another includes means for rotating said base with respect to said cover.

4. The device of claim 2, wherein said means for spacing said base and cover apart from one another includes means for rotating said base with respect to said cover.

5. The device of claim 1, wherein said base is divided into a plurality of base sections, and wherein said means for spacing said base and cover apart includes means for independently rotating each of said plurality of base sections with respect to said cover, independently of any other of said plurality of base sections.

6. The device of claim 2, wherein said base is divided into a plurality of base sections, and wherein said means for spacing said base and cover apart includes means for independently rotating each of said plurality of base sections with respect to said cover, independently of any other of said plurality of base sections.

* * * * *